US006427493B1

(12) United States Patent
Kasdan et al.

(10) Patent No.: US 6,427,493 B1
(45) Date of Patent: Aug. 6, 2002

(54) SYNTHETIC KNIT FABRIC HAVING SUPERIOR WICKING AND MOISTURE MANAGEMENT PROPERTIES

(75) Inventors: Robert Kasdan, New York, NY (US); Stanley Kornblum, Monmouth Junction, NJ (US)

(73) Assignee: Concord Fabrics, Inc., New York, NY (US)

( * ) Notice: Subject to any disclaimer, the term of this patent is extended or adjusted under 35 U.S.C. 154(b) by 0 days.

(21) Appl. No.: 09/127,495

(22) Filed: Jul. 31, 1998

(51) Int. Cl.[7] ..... D04B 1/16
(52) U.S. Cl. ..... 66/169 R; 66/202
(58) Field of Search ..... 66/193, 195, 197, 66/202, 185, 183, 184, 187; 2/239, 409; 604/378

(56) References Cited

U.S. PATENT DOCUMENTS 5,269,720 A * 12/1993 Moretz et al. ..... 66/196
5,284,031 A * 2/1994 Stoll et al. ..... 66/196
5,312,667 A * 5/1994 Lumb et al. ..... 428/91
5,319,807 A * 6/1994 Brier ..... 66/196
5,414,870 A * 5/1995 Moretz et al. ..... 66/196
5,547,733 A * 8/1996 Rock et al. ..... 428/91
5,735,145 A * 4/1998 Pernick ..... 66/196
5,787,503 A * 8/1998 Murphy, III ..... 66/196

* cited by examiner

*Primary Examiner*—Danny Worrell
(74) *Attorney, Agent, or Firm*—Cowan, Liebowitz & Latman, P.C.; Michael I. Wolfson; William H. Dippert

(57) ABSTRACT

A weft knit synthetic fabric having an irregular pique construction prepared on a double knit machine having four feeds, two of which are microfiber yarn and two of which are regular non-microfiber yarn. The fabric is formed with at least 40 weight percent microfiber yarn and the balance conventional non-microfiber yarn which is worn against an individual's body for maximum moisture absorption with the microfilament knit on the face to provide maximum siphon to remove the moisture from a wearer's body. The knit fabric is particularly well suited for athletic wear.

10 Claims, 1 Drawing Sheet

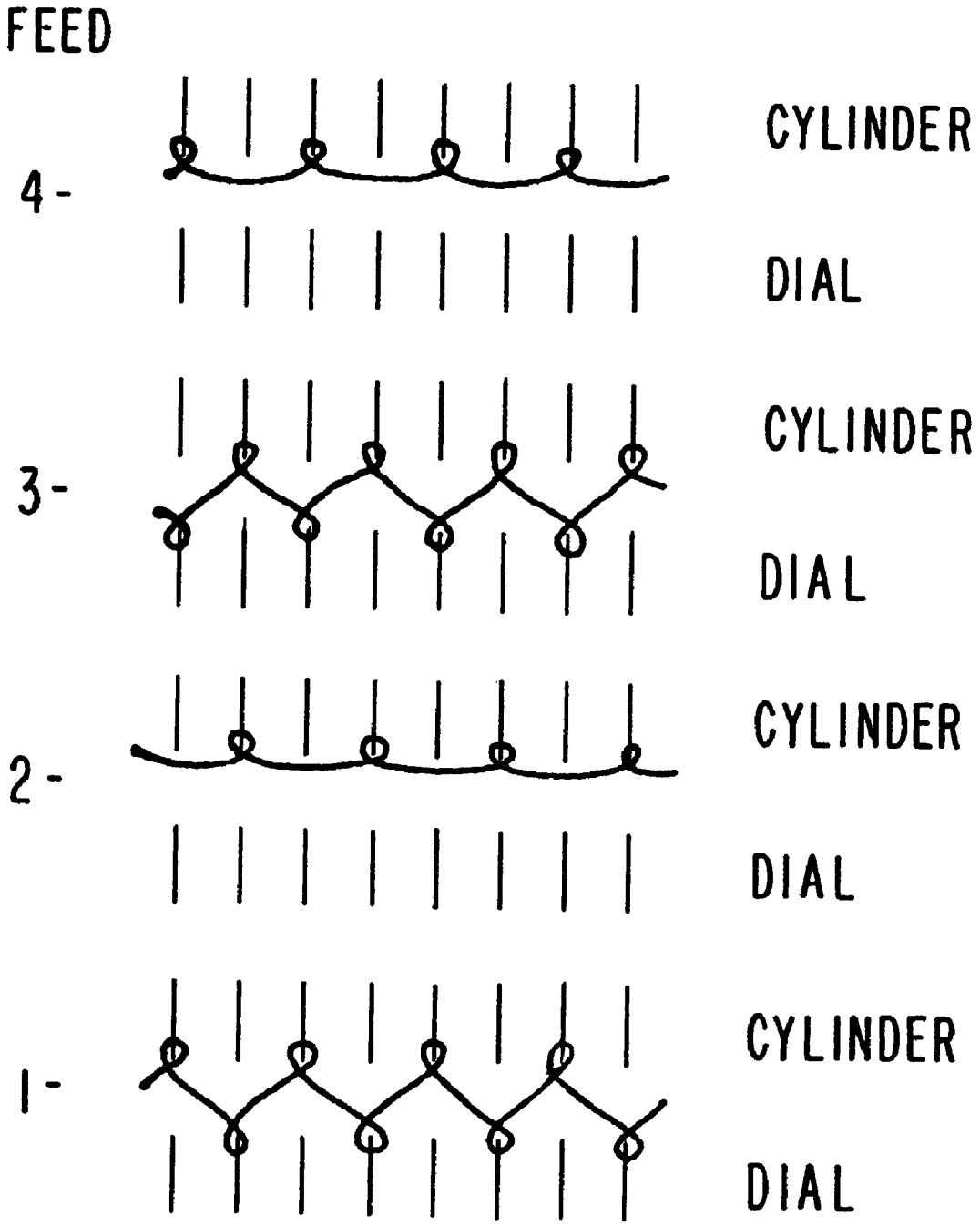
FEED
4-
CYLINDER
DIAL
3-
CYLINDER
DIAL
2-
CYLINDER
DIAL
1-
CYLINDER
DIAL

SYNTHETIC KNIT FABRIC HAVING SUPERIOR WICKING AND MOISTURE MANAGEMENT PROPERTIES

BACKGROUND OF THE INVENTION

This invention relates to a synthetic knit fabric and in particular to a double knit fabric formed from two different synthetic yarns having superior wicking and moisture management properties particularly well suited for athletic wear.

There are a wide variety of fabrics promoted as suitable for athletic wear available today. There fabrics aid in wicking moisture away from the body and aid in evaporation of body moisture created by a wide variety of athletic activities. These athletic fabrics are available in a wide variety of clothing items and are generally fabricated from yarns of synthetic fibers, such as polyester and polypropylene. Natural cotton fibers tend to absorb and retain body moisture, whereas synthetic fibers tend to improve wicking away from the body leading to evaporation of the moisture.

Such wicking fabrics are also available in a wide variety of configurations. For example these may be a simply knit jersey, brushed polyester fabrics and various types of fleece material.

An additional well known product used in athletic wear is Gore-Tex. This is a porous material which allows water vapor generated by the body to pass through the fabric while being resistant to moisture drops passing through from the outer skin of the fabric to the body. Such fabrics tend to be expensive and find primary use in applications where it is desirable to impart a waterproof property to a garment. These garments are widely used in skiwear.

Notwithstanding the availability of these fabrics, it remains desirable to provide improved synthetic knit fabrics having superior wicking action and improved evaporation of body moisture.

SUMMARY OF THE INVENTION

Generally speaking, in accordance with the invention, a superior wicking fabric formed of a knit of two synthetic yarns is provided. The yarns are generally a synthetic microfiber yarn and a synthetic non-microfiber yarn which are knit into an irregular pique knit which is a modification of the basic pique stitch. The irregular knit pique construction allows for the conventional non-microfiber yarn to be on the back of the fabric to be worn against the body for maximum moisture absorption. The microfiber yarn is knit to be on the exposed face of the fabric creating a rapid path for siphoning and evaporation of body moisture absorbed by the non-microfiber face. Preferably, the fabric is made up with an equal weight of microfiber and non-microfiber yarns, both yarns being polyester.

Accordingly, it is an object of the invention to provide an improved fabric having superior wicking properties for improving evaporation of body moisture.

Another object of the invention is to provide an improved wicking and moisture management fabric formed by preparing a double knit of two different fibers.

A further object of the invention is to provide an improved wicking and moisture management fabric knit from a conventional synthetic fiber to be worn adjacent to the body and a synthetic microfiber on the outside surface.

Yet another object of the invention is to provide a fabric having improved wicking and moisture management properties knit in an irregular pique stitch.

Still another object of the invention is to provide an improved and moisture management fabric prepared from two different types of polyester yarns knit by an irregular pique stitch.

Still other objects and advantages of the invention will in part be obvious and will in part be apparent from the specification.

The invention accordingly comprises the several steps and the relation of one or more of such steps with respect to each of the others, and the article possessing the features, properties, and the relation of elements, which are exemplified in the following detailed disclosure, and the scope of the invention will be indicated in the claims.

BRIEF DESCRIPTION OF THE DRAWINGS

For a fuller understanding of the invention, reference is had to the following description taken in connection with the accompanying drawing(s), in which:

FIG. 1 is a pattern diagram of an irregular knit pique for a double knit moisture management fabric constructed and arranged in accordance with the invention.

DESCRIPTION OF THE PREFERRED EMBODIMENTS

The irregular pique knit fabric prepared in accordance with the invention is a weft double knit fabric. A double knit fabric is knitted on a circular machine by interlocking loops with a double stitch utilizing two sets of needles to form a fine ribbed cloth with a twice-knitted appearance. Each set of needles works at right angles to the other. The knits are produced by the interlock stitch and by variation of that process. Both surfaces of the fabric are somewhat rib like in appearance.

The moisture management fabric prepared in accordance with the exemplary embodiment of the invention is knit on a 28 cut double knit machine utilizing two tracks on the dial and two tracks on the cylinder. The yarn is synthetic, and may be textured nylon, polyester or polypropylene. Preferably, the fabric is knit from all polyester yarns. In the preferred embodiment the yarn is a combination of a conventional staple yarn and a microfiber yarn. The conventional non-microfiber yarn for the back surface of the fabric may be from 50 to 100 denier and have from 25 to 50 filaments. The microfiber yarn for the outer face of the fabric is also from 50 to 100 denier with at least 80 filaments and may include 120 filaments and more. The yarns are knit so that a greater percentage of the non-microfiber yarn is worn against the wearer's body for moisture management absorption and the microfiber yarn is on the outer face of the fabric to provide a maximum siphon effect to remove moisture from the non-microfiber face.

Preferably, the back of the fabric to be worn against the body is a 70 denier, 34 filament polyester yarn. A 70 denier, 100 filament microfiber is used to knit the face of the fabric. Both yarns are polyester and are knit in the pattern illustrated in FIG. 1.

The pattern illustrated in FIG. 1 is an irregular pique construction. This allows for a large surface of the staple 70 denier, 34 polyester filament yarn to be against the body with the more dense 70 denier, 100 filament microfiber yarn on the outside of the fabric. This particular construction based on the selection of yarns, amount of conventional fiber to be worn against the body compared to the amount of microfiber on the outside of the fabric, and knit pattern provides for maximum moisture absorption and wicking of body moisture away from the wearer's body.

Preferably, the fabric prepared in accordance with the invention has at least 40 weight percent microfiber yarn on the face of the fabric with the balance being non-microfiber warm against the body. Additionally, the microfiber yarn should have a denier at least twice that of the conventional non-microfiber yarn.

The following examples are presented to illustrate the invention and demonstrate its advantages. It is not intended in a limiting sense.

EXAMPLE 1

An actual fabric prepared utilizing 70 denier, 34 filament polyester yarn on the back and 70 denier, 100 filament microfiber on the front was knit on a 28 cut double knit machine utilizing two tracks on the dial and two tracks on the cylinder. The fabric knit specifications as set forth in the following TABLE I.

TABLE I

IMPROVED MOISTURE MANAGEMENT FABRIC KNIT SPECIFICATION

| Machine Type-Cut-Feeds | | | | | Gating | | | Timing | | | | | | | Dial Height |
|---|---|---|---|---|---|---|---|---|---|---|---|---|---|---|---|
| Eightlock 28 84 | | | | | Rib. | Int. | | Syn | Cil+ | Dial | | | | | .055 |
| | | | | | | X | | X | | | | | | | |
| NEEDLES ARRANGEMENT | | | | | | | | | | | | | | | Mach. RPM |
| Cylinder | 2 Track | | | | Dial | | | 2 Track | | | | | | | 29 |
| Feeds | Yarn | Dial Needles | | | Cylinder Needles | | | Tension | Dial Set | | | Cylinder Set | | | Inches per Course |
| 1 | 70/100 | F | B | W | SEL | ALL | W | 5 | T | M | L | T | M | L | 355 |
| | | | X | | S | | | | X | X | | X | X | | |
| 2 | 70 | F | B | W | SEL | ALL | W | | T | M | L | T | M | L | 180 |
| | | | | X | 1 | | | | X | X | | X | X | | |
| 3 | 70/100 | F | B | W | SEL | ALL | W | 5 | T | M | L | T | M | L | 180 |
| | | X | | | 1 | | | | X | X | | X | X | | |
| 4 | 70 | F | B | W | SEL | ALL | W | 5 | T | M | L | T | M | L | 180 |
| | | | | X | S | | | | X | X | | X | X | | |
| 5 | 70/100 | F | B | W | SEL | ALL | W | 5 | T | M | L | T | M | L | 180 |
| | | | X | | S | | | | X | X | | X | X | | |
| 6 | 70 | F | B | W | SEL | ALL | W | 5 | T | M | L | T | M | L | 180 |
| | | | | X | C | | | | X | X | | X | X | | |
| 7 | 70/100 | F | B | W | SEL | ALL | W | 5 | T | M | L | T | M | L | 180 |
| | | X | | | 1 | | | | X | X | | X | X | | |
| 8 | 70 | F | B | W | SEL | ALL | W | 5 | T | M | L | T | M | L | 180 |
| | | | | X | S | | | | X | X | | X | X | | |

These knit specifications result in a fabric of approximately 7 ounces per linear yard for a width of about 62–64 inches or approximately 3.94 ounces per square yard. The resulting fabric has about 50 percent by weight of an outer face of microfiber 70 denier yarns with the balance being the staple 34 denier non-microfiber yarns.

EXAMPLE 2

The 28 cut irregular pique double knit fabric prepared in accordance with Example 1 was tested to demonstrate the superior wicking and siphoning action. In this test a drop of distilled water was placed on the inside of the fabric formed with the conventional 70 denier, 34 filament polyester yarn. The test was conducted in an atmosphere of 65% relative humidity at 70° F. The time for the drop of water to be absorbed completely was 0.0 seconds.

EXAMPLE 3

In comparison, the distilled water drop test was repeated on a specimen of a piece of fabric taken from a T-shirt bearing the designation NIKE Dry-F.I.T.®. The NIKE Dry-F.I.T. is an all polyester fabric with a face of 70 denier/100 filament microfiber yarn and a back of 70 denier/50 filament yarn. The face yarn is 67% by weight and the back yarn is 33% by weight of the fabric. The distilled water drop was placed on the inside of the garment as for the fabric in the Example 2. The time for the water drop to be completely absorbed was 1.0 seconds.

EXAMPLE 4

This test further compared the moisture wicking properties of the irregular pique knit fabric prepared in accordance with Example 1 and the NIKE Dry-F.I.T. T-shirt fabric utilized in Example 3. Here, two 1" strips of each fabric, one cut in the wale direction and one cut in the course direction, were placed in water in an atmosphere of 65% relative humidity at 70° F. The results of the comparison showing the height of the wicking action in the wale direction and along the course direction of each fabric over five minutes are as set forth in Table II.

TABLE II

WICKING COMPARISON TEST RESULTS

| EXAMPLE I FABRIC HEIGHT OF WICKING | | | NIKE DRY F.I.T. FABRIC HEIGHT OF WICKING | | |
|---|---|---|---|---|---|
| TIME/sec. | LENGTH/ cm (wale direction) | WIDTH/ cm (course direction) | TIME/sec. | LENGTH/ cm (wale direction) | WIDTH/ cm (course direction) |
| 30 | 5.00 | 3.50 | 30 | 2.00 | 2.60 |
| 60 | 7.00 | 5.00 | 60 | 3.00 | 3.70 |
| 90 | 8.00 | 6.00 | 90 | 3.80 | 4.40 |
| 120 | 8.80 | 6.70 | 120 | 4.50 | 5.00 |
| 150 | 9.60 | 7.50 | 150 | 4.90 | 5.40 |
| 180 | 10.10 | 8.00 | 180 | 5.30 | 5.80 |
| 210 | 10.60 | 8.50 | 210 | 5.70 | 6.10 |
| 240 | 11.00 | 8.90 | 240 | 6.00 | 6.30 |
| 270 | 11.50 | 9.30 | 270 | 6.30 | 6.50 |
| 300 | 11.90 | 9.60 | 300 | 6.40 | 6.60 |

The results of the comparative distilled water drop test and wicking test demonstrate that a weft-knit fabric prepared utilizing the conventional polyester yarn and microfiber polyester yarns knit in a special irregular knit pique construction as shown in FIG. 1 lead to improve wicking and siphoning of moisture. The comparative Examples 2–4 demonstrate the superiority in both the distilled water drop absorbency and the 1" strip moisture wicking in both wale and course direction. Both tests were conducted at 65% and 70° F.

It will thus be seen that the objects set forth above, among those made apparent from the preceding description, are efficiently attained and, since certain changes may be made in carrying out the above method and in the construction(s) set forth without departing from the spirit and scope of the invention, it is intended that all matter contained in the above description and shown in the accompanying drawings shall be interpreted as illustrative and not in a limiting sense.

It is also to be understood that the following claims are intended to cover all of the generic and specific features of the invention herein described and all statements of the scope of the invention which, as a matter of language, might be said to fall therebetween.

Particularly it is to be understood that in said claims, ingredients or compounds recited in the singular are intended to include compatible mixtures of such ingredients wherever the sense permits.

What is claimed is:

1. A double knit fabric layer for moisture management by removing moisture from a wearer's body, comprising a regular synthetic yarn on the back of the fabric layer to be worn against a wearer's body, and a microfiber synthetic yarn on the outer face of the fabric layer, the regular yarn and microfiber yarn weft knit together on a double knit knitting machine to form the fabric layer.

2. The double knit fabric of claim 1, knit in an irregular pique pattern.

3. The double knit fabric of claim 1, wherein the microfiber comprises at least 40 weight percent of the fabric.

4. The double knit fabric of claim 1, wherein the yarns are polyester.

5. The double knit fabric of claim 1, wherein the irregular knit pique construction is formed with a repeat pattern of at least 4 yarn feeds and 2 alternating wales, with a 70 denier, 100 filament microfiber fed to the first and third yarn feeds and a 70 denier, 34 filament yarn fed to the second and fourth yarn feeds.

6. The double knit fabric of claim 1, wherein:

the conventional non-microfiber yarn has a denier, between 50 and 100 and between 20–50 filaments on the back of the fabric, and the microfiber yarn having a denier between 50 and 100 and twice the number of filaments as the conventional yarn, on the face of the fabric.

7. A double knit fabric, comprising:

a 70 denier, 34 filament yarn on the back of the fabric, and a 70 denier, 100 filament microfiber on the face of the fabric.

8. The double knit fabric of claim 7, wherein the double knit is knitted in an irregular knit pique construction.

9. The double knit fabric of claim 7, wherein the irregular knit pique construction is formed with a repeat pattern of at least 4 feed yarns and 2 alternating wales, the 70 denier, 100 filament microfiber fed to the first and third yarn feeds and the 70 denier, 34 filament yarn fed to the second and fourth yarn feeds.

10. A method of knitting a double knit fabric having improved wicking action on a double knit machine having four feeds, comprising:

feeding a microfilament yarn to the first and third feed and feeding a non-microfiber to the second and fourth feed of a 28 cut double knit machine.

* * * * *